US007722471B2

(12) United States Patent
Smith

(10) Patent No.: US 7,722,471 B2
(45) Date of Patent: May 25, 2010

(54) BILLIARD GAME WITH CHESS INDICIA AND METHOD OF PLAY

(76) Inventor: Duane Smith, 2577-A Oak Shadow La., Atlanta, GA (US) 30345

( * ) Notice: Subject to any disclaimer, the term of this patent is extended or adjusted under 35 U.S.C. 154(b) by 3 days.

(21) Appl. No.: 11/852,411

(22) Filed: Sep. 10, 2007

(65) Prior Publication Data

US 2009/0066019 A1 Mar. 12, 2009

(51) Int. Cl.
*A63D 15/00* (2006.01)
*A63B 37/00* (2006.01)

(52) U.S. Cl. ..... 473/1; 473/3; 473/52; 473/40

(58) Field of Classification Search ..... 473/52, 473/40, 26, 25, 27
See application file for complete search history.

(56) References Cited

U.S. PATENT DOCUMENTS

| | | | | | |
|---|---|---|---|---|---|
| 197,091 | A | | 11/1877 | Brown | |
| 580,253 | A | * | 4/1897 | Clarke | 473/52 |
| 666,333 | A | * | 1/1901 | Stevens | 473/52 |
| 984,463 | A | * | 2/1911 | Beltran | 473/52 |
| 1,509,678 | A | | 9/1924 | MacPherson et al. | |
| D220,634 | S | * | 5/1971 | Fontana | D21/316 |
| 3,680,859 | A | * | 8/1972 | English | 473/40 |
| 3,741,543 | A | | 6/1973 | McPhail et al. | |
| 3,976,293 | A | | 8/1976 | Laureta | |
| 4,004,804 | A | | 1/1977 | Gholson | |
| 4,065,125 | A | | 12/1977 | Chan | |
| 4,114,876 | A | | 9/1978 | Maruszak | |
| 4,116,439 | A | * | 9/1978 | Chavarria et al. | 473/52 |
| 4,201,383 | A | | 5/1980 | Schaller | |
| 4,251,072 | A | | 2/1981 | Anthony | |
| 5,011,147 | A | | 4/1991 | Thomas et al. | |
| 5,039,099 | A | | 8/1991 | Bravo | |
| 5,372,364 | A | | 12/1994 | Arroyo | |
| 5,716,284 | A | | 2/1998 | Maldonado | |
| 5,734,370 | A | * | 3/1998 | Skodlar | 463/38 |
| D493,496 | S | | 7/2004 | Tompkins | |
| 6,761,642 | B2 | | 7/2004 | Ye | |
| 6,902,490 | B1 | | 6/2005 | Swearman | |
| D517,611 | S | | 3/2006 | Alavi | |
| D525,315 | S | | 7/2006 | Fergusson | |
| 7,090,587 | B2 | | 8/2006 | Kim | |
| 2008/0182675 | A1 | * | 7/2008 | Flores | 473/27 |

FOREIGN PATENT DOCUMENTS

DE 20312140 U1 * 11/2003

OTHER PUBLICATIONS

Chess Pool—ver. 0.50; by Robert Price.*

(Continued)

*Primary Examiner*—Mitra Aryanpour
(74) *Attorney, Agent, or Firm*—Rodgers & Rodgers

(57) ABSTRACT

A game is played on a billiard type table using balls with indicia of chess pieces. A cue stick is used to strike the balls following rules of movement that vary with the indicia on the ball to be moved. Game rules control movement and pocketing of balls are representative of the movement and capture of chess pieces, but are modified for use on a billiard table. The game is also adaptable to other playing surfaces including electronic displays.

3 Claims, 11 Drawing Sheets

OTHER PUBLICATIONS

Billiards—General Accessories—Billiard Ball Chess Pieces (old-west-guns.com).*
Three Kinds of Billiards Chess.*
Robert Price; Chess Pool;Website Publication date unknown—Robots.txt will not allow indexing via web.archive.org; http://www.chessvariants.org/crossover.dir/chesspool.html.

* cited by examiner

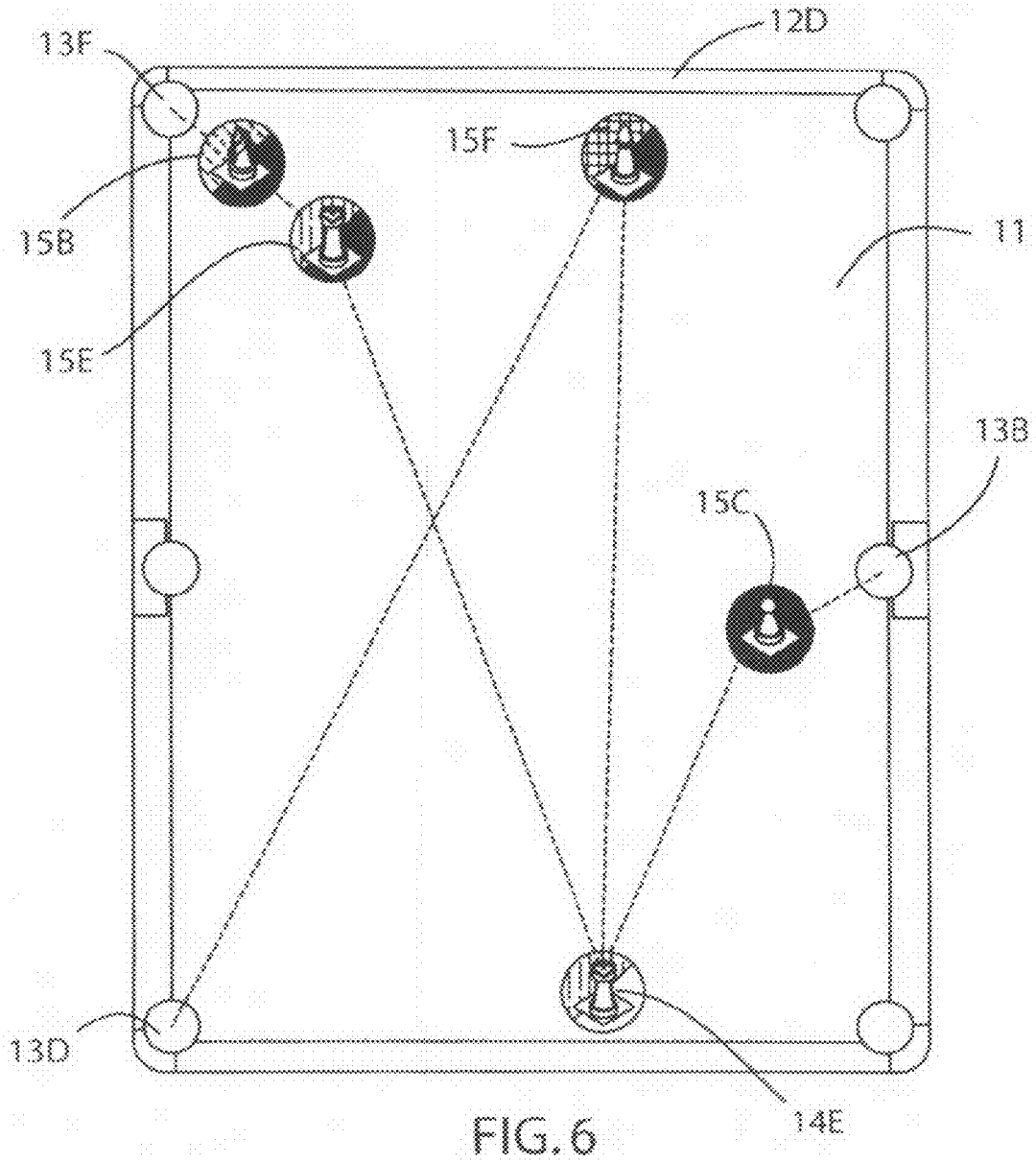
FIG. 6
FIG. 7
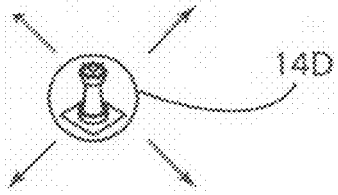

BILLIARD GAME WITH CHESS INDICIA AND METHOD OF PLAY

BACKGROUND OF THE INVENTION

The present invention relates primarily to billiard type games. More specifically, the present invention relates to a method and apparatus for playing a billiard type game that adapts rules and indicia from the game of chess to create a new and enjoyable billiard type game.

For many years the game of billiards has been a popular game played in the home, at billiard clubs, pool halls, bars, and at recreational facilities. Further, the popularity of billiards is demonstrated by the amount of sales of billiard related items, and also the many billiard tournaments, some of which are even televised. As such, various types of billiard games have been introduced into the marketplace and the prior art provides many examples of these various billiard games including various table shapes, sizes, various numbers of balls, including many colors and designs, and various rules for playing a variety of games. The prior art also shows examples of billiards combined with other games such as football, golf, and word spelling games.

Chess is a game with an even longer history of popularity. Chess has been played for over a thousand years and remains popular in the home, at school, and is the subject of chess clubs, tournaments, books and news articles. To date, no one has found a way to combine these two popular games in such a way as to be enjoyable and entertaining. Combining chess and billiards would have the advantage of combining the physically dexterous aspects of billiards with the intellectual and strategic aspects of chess.

With the increased popularity of billiard games, and leisure activities in general, many people are willing to spend hundreds or even thousands of dollars on billiard tables and accessories. The accessories may include multiple cue sticks and various sets of balls and racks for playing various games. Additionally, billiard tables also are large and consume substantial floor space. Consequently, the substantial cost of a billiard table and the large amount of space they consume makes it desirable to get as much use from a billiard table as possible. It is therefore advantageous to purchase accessories that permit a billiard table to be used for multiple activities, and used more often, to thereby increase the enjoyment of such a large piece of equipment. Unfortunately, most billiard games are very similar to one another and consequently players may become bored with playing the same or similar games repeatedly. Similar problems apply to the electronics industry's game playing systems. In the electronics industry, many billiard games are now adapted to being played on electronic gaming systems, personal computers, and the like. The rules are substantially the same as the physical games, but the playing surface, balls, and cue sticks are virtual and are represented on an electronic display screen. It is therefore desirable to have new and entertaining games implemented on these electronic gaming platforms.

Accordingly, a need exists for new games and related accessories for billiard tables that provide increased usage, more enjoyment, and more value for the billiard table owner. Similarly there is a need for new billiard games to be adapted to electronic gaming systems. Therefore, a game and related accessories for billiard tables are needed that provide the aforementioned advantages.

SUMMARY OF THE PRESENT INVENTION

The aforementioned drawbacks and disadvantages of the prior art billiard games and accessories have been identified and a solution is set forth herein by an inventive billiard game and method which comprises combining a billiard game with the classic game of chess. Billiard balls are provided for two players or teams. The balls contain indicia that are representative of a chess game piece. For example, a king, a queen, a pawn, a rook, a knight, or a bishop. The pieces also have markings to indicate to which player or team they belong. Player markings are, for example, indicated with white balls for the balls of a first player and dark balls for the balls of a second player. To start a game, the balls are positioned in predetermined positions on the playing surface in two rows at each end of the table. The balls with indicia of pawns are in the first row and the remaining pieces are in a second row. The placement of the balls is preferably accomplished using a specially designed rack and each player or team places their balls at their end of the billiard table. Players then take turns and use a cue stick to hit one of their balls. Opponent's balls are captured when they are propelled into a pocket of the billiard table. A player's turn is over, regardless of whether a ball is successfully pocketed or not, after the player strikes a ball. This is unlike traditional billiard games where a player resumes taking shots until a ball ceases to be pocketed, or the player scratches, or otherwise fouls.

One feature of the present invention is the selection of balls to be used. One preferred embodiment uses sixteen balls, wherein, each player has three pawns, one king, one queen, one rook, one knight, and one bishop and no cue ball is required. Of course, one may be used if desired. A further feature is the reduced number of 'pieces' compared to a traditional chess game. The reduced number prevents the game from becoming too crowded on the limited space of the billiard table and adds to the enjoyment of the game.

Another feature of the present invention are the rules controlling how a player may strike or play one of his own balls and how he may strike an opponent's ball. For example, each player is only permitted to hit his own balls with the cue stick and hitting a ball may be done to merely move the ball to another location on the table, or it may be used to strike an opponent's ball. The object of the game is to pocket the opponent's king after all of the opponent's other pieces have been pocketed. In addition, each ball has specific rules associated with how it may be played.

Briefly, the rules for striking each ball are as follows. Balls designated as pawns may only move in the forward direction (i.e. toward the opponent's end of the table). A pawn may pocket an opponent's ball using a straight-in shot. That is to say, pawns may not use bank shots or combination shots. The rook may pocket an opponent's ball only with a straight-in shot. However, the rook may move in any direction. The knight may pocket opponent's balls only with combination shots and may move in any direction. The bishop may pocket an opponent's ball only with bank shots. No combination shots or straight-in shots are permitted. The bishop may move in any direction. The queen may pocket an opponent's ball using straight-in shots, combination shots, or bank shots. The queen may move in any direction. If the queen is pocketed, it may be returned to the table if a pawn reaches the opponents end of the table. Finally, the king may pocket an opponent's ball with straight-in shots. Since one preferred embodiment of the invention does not require a cue ball, a combination shot is defined as any shot using three or more balls. In other words, for example, when a player strikes a first ball with a cue stick and the first ball then strikes a second ball which then strikes a third ball (the object ball) that is intended to be pocketed.

Yet another feature of one embodiment of the present invention are the weight and/or size of the balls designated as queens. These balls may be slightly heavier or of a slightly different size than typical billiard balls. For example, similar to cue balls in traditional billiards, the balls designated as queens are slightly different in weight or size so that they are returned to the players using coin operated tables. This may be needed, for example, so that the queen can be returned to the table in exchange for a pawn if a pawn reaches the opponent's end of the table.

Another feature of the invention are rules limiting the distance a ball may travel when striking an opponent's ball. This limitation is advantageous in simulating the rules of chess. A king may attack an opponent's ball that is no further than one row away. A row is defined as the distance between the diamonds on the side rail. Additionally, whenever a player strikes his object ball with the cue stick for a position play, the ball must move at least one row. Finally, in one embodiment, all shots are required to be called in advance. In this embodiment, no pocketing on 'slop' shots are allowed.

To address the goals stated above, the inventive billiard game with chess indicia and method combines the best attributes of both the game of billiards and the game of chess. By combining these two popular games the invention creates a new and interesting game for use on existing billiard tables. By solving the many difficulties associated with combining these two games, the invention provides a cost effective way to implement a new game for billiard tables around the world. The invention is applicable to any billiard table whether in a home, billiards club, bar, recreational facility, or elsewhere.

The present invention includes a method of playing this new game which may include, among other things, rules for moving the balls, rules for striking opponents balls, specifications for various weights and sizes for the balls, initial positions of the balls, and the like to achieve the desired new and useful game.

The invention comprises a billiard game having a plurality of balls, each of said balls having an indicia representative of a chess piece. The invention further comprises a playing surface and the plurality of balls positioned on the playing surface. The balls preferably each have an indicia of a chess piece. There is at least one pocket adjacent to the playing surface that is suitable for receiving said balls. In the preferred embodiment of a billiard table, there are obviously six pockets. The preferred embodiment includes a cue stick suitable for a player to strike one of the balls and thereby propel the ball on the playing surface.

The invention further comprises rules governing the play of said balls, wherein the play of each of said balls is governed by said indicia on each of said balls.

The game also comprises a playing surface; a plurality of balls, at least one ball having indicia indicative of a chess piece; at least one pocket adjacent to said surface, said pocket suitable for receiving at least one of said balls; and, rules of play controlling the play of said plurality of balls, said rules of play of each of said balls dependent on the chess indicia on each of said balls.

A method of playing the game comprising the steps of: providing a playing surface; providing a plurality of balls having indicia representative of chess pieces; positioning said balls on said playing surface; providing at least one pocket adjacent to said playing surface, said pocket suitable for receiving at least one of said balls; and, wherein the play of each of said balls is governed by said indicia on each of said balls.

Other objects, advantages, and features of the invention will become apparent upon consideration of the following detailed description when taken in conjunction with the accompanying drawings. The above brief description sets forth rather broadly the more important features of the present disclosure so that the detailed description that follows may be better understood, and so that the present contributions to the art may be better appreciated. There are, of course, additional features of the disclosures that will be described hereinafter which will form the subject matter of the claims.

In this respect, before explaining the preferred embodiment of the disclosure in detail, it is to be understood that the disclosure is not limited in its application to the details of the construction and the arrangement set forth in the following description or illustrated in the drawings. The billiard game and method of the present disclosure is capable of other embodiments and of being practiced and carried out in various ways. Also, it is to be understood that the phraseology and terminology employed herein are for description and not limitation.

As such, those skilled in the art will appreciate that the conception, upon which this disclosure is based, may readily be used as a basis for designing other structures, methods, and systems for carrying out the several purposes of the present invention. It is important, therefore, that the claims are regarded as including such equivalent constructions as far as they do not depart from the spirit and scope of the present invention.

Further, the purpose of the Abstract is to enable the U.S. Patent and Trademark Office and the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any way.

These and other objects, along with the various features, methods, and structures that characterize the invention, are pointed out with particularity in the claims annexed to and forming a part of this disclosure. For a better understanding of the present disclosure, its advantages, and the specific objects attained by its uses, reference should be made to the accompanying drawings and descriptive matter in which there are illustrated and described the preferred embodiments of the invention.

As such, while embodiments of the billiard game with chess indicia are herein illustrated and described, it is to be appreciated that various changes, rearrangements and modifications may be made therein, without departing from the scope of the invention as defined by the claims.

BRIEF DESCRIPTION OF THE DRAWINGS

As a compliment to the description and for better understanding of the specification presented herein, ten pages of drawings are disclosed with an informative, but not limiting, intention.

FIG. 6 illustrates the rules for moving a queen in one embodiment of the present invention;

FIG. 7 illustrates the rules for moving a king in one embodiment of the present invention;

DETAILED DESCRIPTION OF THE PREFERRED EMBODIMENT

The best mode for carrying out the invention is presented in terms of the preferred embodiment. Similar referenced characters designate corresponding features throughout the several figures of the drawings.

Figure 1:
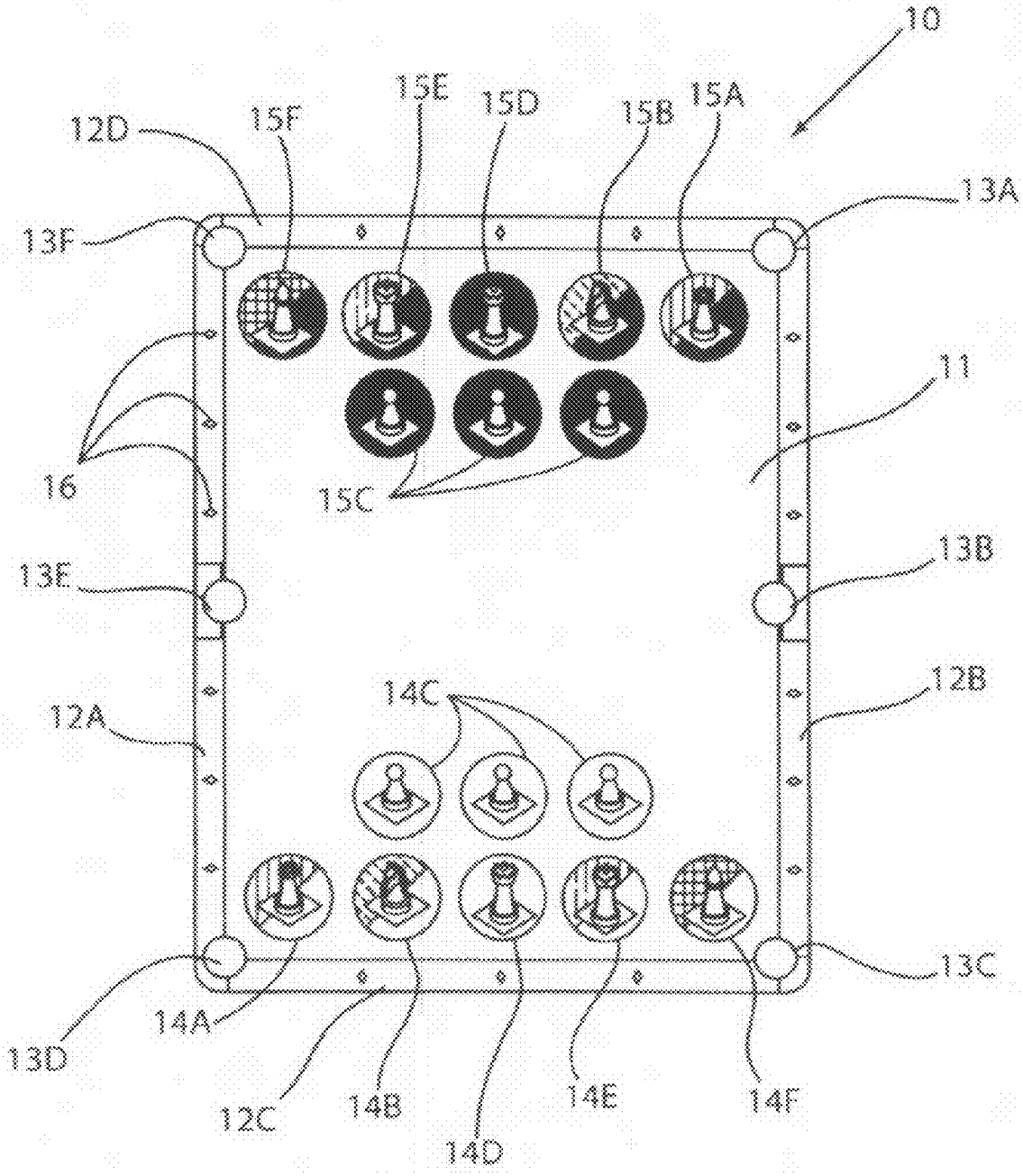
FIG. 1 illustrates a billiards table of one embodiment of the present invention with the balls in the initial position.

For purposes of description herein, the terms "left" and "right" shall relate to the invention as oriented in FIG. 1 and viewed from above. However, it is to be understood that the invention may assume various alternative orientations, except where expressly specified to the contrary. It is also to be understood that the specific devices and methods illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Reference will now be made in detail to the present preferred embodiments of the invention, examples of which are illustrated in the accompanying drawings. Wherever possible, these same referenced numerals will be used throughout the drawings to refer to the same or like parts. Like features between the various embodiments utilize similar numerical designations. Where appropriate, the various similar features have been further differentiated by an alphanumeric designation, wherein the corresponding alphabetic designator has been changed. Further, the dimensions illustrated in the drawings (if provided) are included for purposes of example only and are not intended to limit the scope of the present invention.

An exemplary embodiment of the invention is shown in FIG. 1. While one preferred embodiment is a professional size billiard table, the invention is not meant to be so limited. Those skilled in the art will understand that the invention may be adapted to other size billiard tables, to game tables, electronic gaming systems, and the like.

The components of the invention will first be briefly described and then described in detail. The billiard table 10 on which the invention is implemented is viewed from the top. Billiard table 10 includes a playing surface 11, a left side rail 12A, a right side rail 12B, a first end rail 12C and a second end rail 12D. Six pockets 13A-13F are adjacent to the playing surface 11. The white balls 14 include rook 14A, knight 14B, three pawns 14C, king 14D, queen 14E, and bishop 14F. The dark balls 15 include rook 15A, knight 15B, three pawns 15C, king 15D, queen 15E, and bishop 15F.

Hencefore, one preferred embodiment will be described. However, this is merely for description and the color, weight, indicia, and the like on balls 14 and 15 may be changed, as well as the particular rules of play herein explained, to suit the particular requirements of the game and the players.

Billiard table 10 in one embodiment is a conventional billiard table with conventional playing surface 11, rails 12, pockets 13, and diamond markings 16. A specific advantage of the invention is that it is readily retrofited to existing billiard tables worldwide. However, those skilled in the art recognize the invention may be used on various sizes and types of tables and/or playing surfaces.

All balls are typically of conventional size, weight and construction as conventional billiard balls. However, in one preferred embodiment, white balls 14 and dark balls 15 vary from traditional billiard balls in the color and indicia on each ball. One set of preferred indicia are shown in FIG. 1 and are shown in detail in FIGS. 8 and 9. One purpose for coloring the balls is to indicate to which player the sets of (white) balls 14 and (dark) balls 15 belong. For example, the set of white balls 14 are played by a first player and the set of dark balls 15 are played by a second player. The purpose of the indicia is to communicate what chess piece each specific white ball 14 or dark ball 15 represents. Those skilled in the art understand that a wide range of indicia are possible. This is illustrated by the wide variety of designs for chess pieces. The variations in design are many: the purpose is to communicate the type of piece to the players.

Queen balls 14E and 15E may also vary from the other white balls 14 and dark balls 15 in their weight or size. The queen balls 14E and 15E, in one embodiment, preferably weigh slightly more that than the other balls 14 and 15. In this embodiment, queen balls 14E and 15E preferably weigh the same as cue balls used in commercial establishments and thereby facilitate the use of coin operated billiard tables. In another embodiment, the queen balls 14E and 15E are slightly larger than the other balls 14 and 15 and thereby facilitate the use of coin operated billiard tables. The added weight or size allows the balls to be returned to the players if it is sunk in a coin operated game table.

Figure 2:
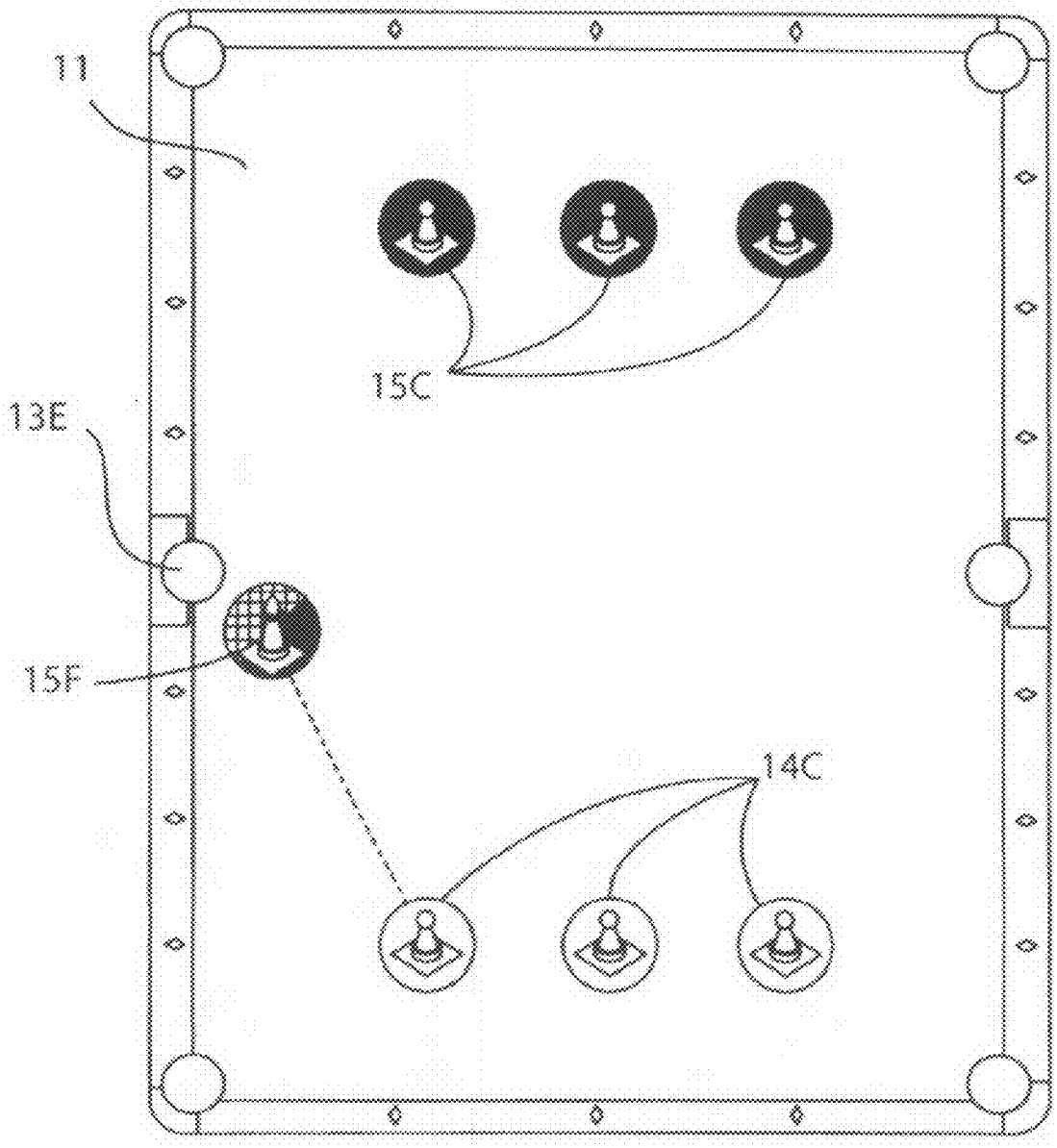
FIG. 2 illustrates the rules for moving a pawn in one embodiment of the present invention.

Referring now to FIG. 2, there is illustrated the play of a white pawn 14C. As mentioned above, pawns are only permitted to move forward (i.e. toward the opposing player's end). Pawns 14C and 15C may only pocket an opponent's piece with a straight-in shot. White pawn 14C is shown striking an opponent's bishop 15F for a straight-in shot to side pocket 13E. Pawns 14C and 15C can be exchanged for a previously pocketed queen 14E or 15E (see FIG. 1) when the pawn 14C or 15C advances within an opponent's home zone as defined by the last row of diamonds on the side rails 12A and 12B. Pawns 14C and 15C can only pocket opponent's pieces that are up table (i.e. forward) of the pawn 14C or 15C. Pawns 14C and 15C are not allowed to make bank shots or combination shots.

Figure 3:
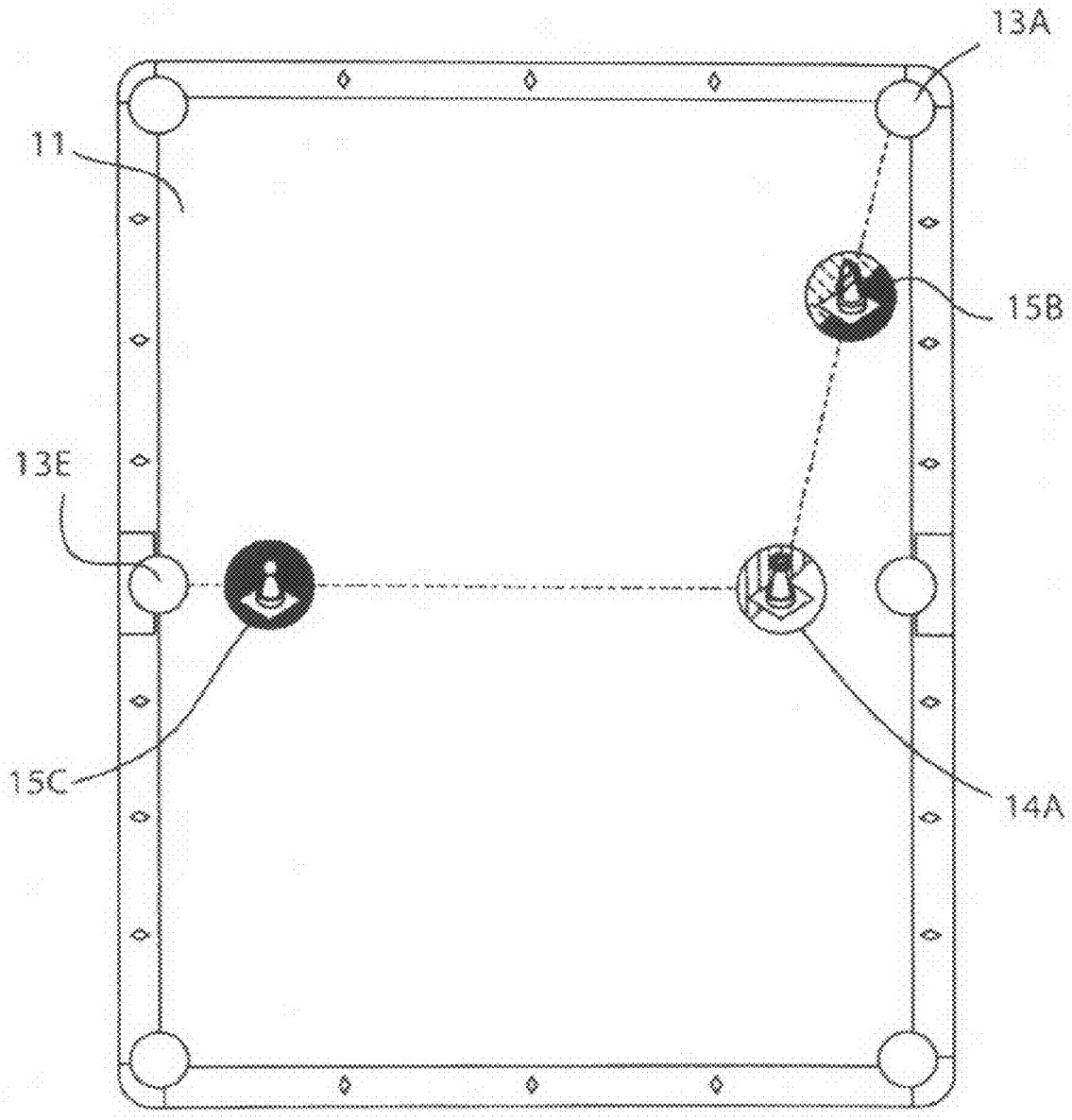
FIG. 3 illustrates the rules for moving a rook in one embodiment of the present invention.

Referring now to FIG. 3, there is illustrated the play of a white rook 14A. As mentioned above, rooks 14A and 15A are permitted to move in any direction. Rooks 14A and 15A may only pocket an opponent's piece with a straight-in shot. White rook 14A is shown striking an opponent pawn 15C for a straight-in shot to pocket 13E. White rook 14A is also shown with the option to pocket opponent's knight 15B with a straight-in shot to corner pocket 13A. Rooks 14A and 15A are permitted to pocket an opponent's ball at any distance. However, rooks 14A and 15A are not permitted to use bank shots or combination shots.

Figure 4:
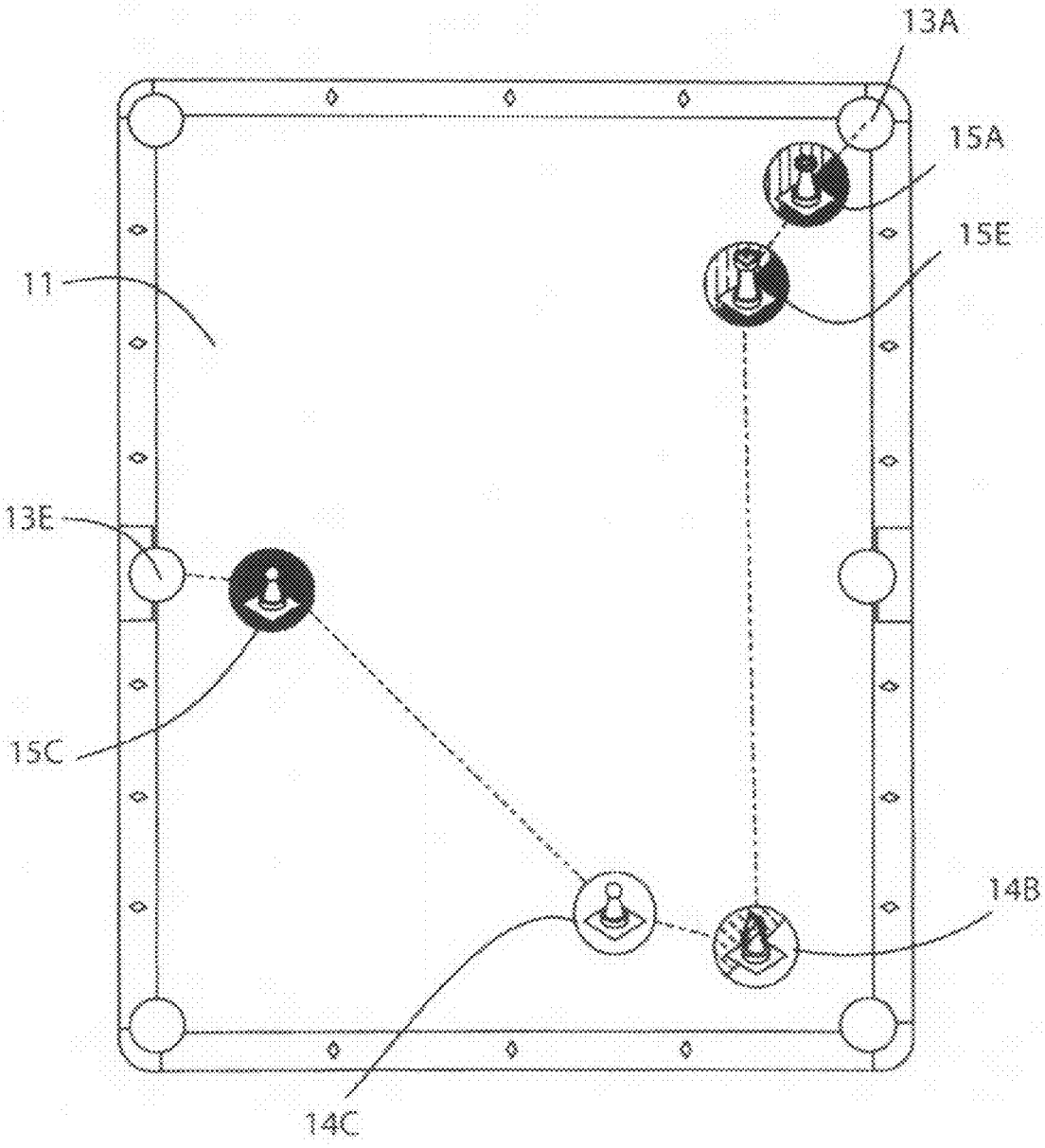
FIG. 4 illustrates the rules for moving a knight in one embodiment of the present invention.

Referring now to FIG. 4, there is illustrated the play of a white knight 14B. As mentioned above, knights 14B and 15B are permitted to move in any direction. Knights 14B and 15B may only pocket an opponent's piece with a combination shot. For example, white knight 14B is shown striking a white pawn 14C which then strikes opponent's pawn 15C. Dark pawn 15C is sunk in side pocket 13E. Similarly, white knight 14B may strike opponent's queen 15E which then strikes opponent's rook 15A. Dark rook 15A is sunk in corner pocket 13A. Knights 14B and 15B may use any balls (even opponent's) in sequence to make a combination shot. Knights 14B and 15B are also permitted to pocket an opponent's ball at any distance.

Figure 5:
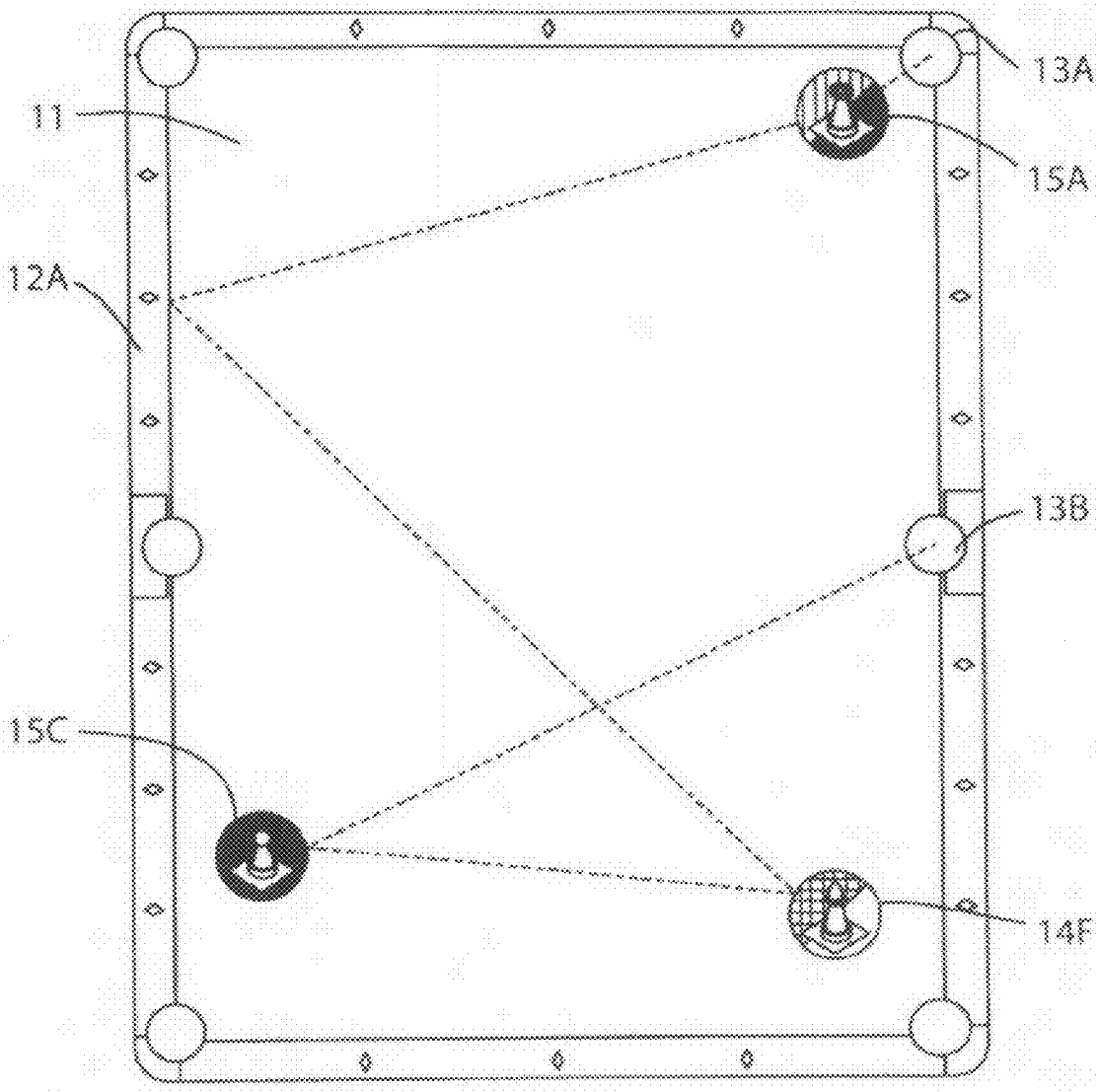
FIG. 5 illustrates the rules for moving a bishop in one embodiment of the present invention.

Referring now to FIG. 5, there is illustrated the play of a white bishop 14F. As mentioned above, bishops 14F and 15F are permitted to move in any direction. Bishops 14F and 15F may only pocket an opponent's piece using bank shots. Two shots are illustrated. In a first example, bishop 14F is shown striking a dark pawn 15C. Dark pawn 15C banks off of rail 12A and is sunk in side pocket 13B. In another example, white bishop 14F banks off of rail 12A and strikes opponent's rook 15A. Dark rook 15A is sunk in corner pocket 13A. Bishops 14F and 15F may use any balls (even opponent's) in sequence to make a bank shot. Bishops 14F and 15F are permitted to strike either a ball or a rail initially in executing a bank shot. Bishops 14F and 15F are also permitted to pocket an opponent's ball at any distance.

Referring now to FIG. 6, there is illustrated the play of a queen 14E. As mentioned above, queens 14E and 15E are permitted to move in any direction. Queens 14E and 15E may pocket an opponent's piece using any type of shot including straight-in shots, bank shots, or combination shots. Three shots are illustrated. In a first example, a combination shot is shown with queen 14E striking a dark queen 15E which strikes dark knight 15B. Dark knight 15B is sunk in corner pocket 13F. In another example, a bank shot is shown with queen 14E striking dark bishop 15F. Dark bishop 15F banks off of rail 12D and is sunk in corner pocket 13D. In a third example, queen 14E uses a straight-in shot to strike dark pawn 15C which is sunk in side pocket 13B. Queens 14E and 15E may use any balls (even opponent's) in sequence to make a combination shot. Queens 14E and 15E are also permitted to pocket an opponent's ball at any distance. If the queen 14E or 15E is pocketed by an opponent, it may return to the table in exchange for a pawn residing in the opponent's zone.

FIG. 7 shows the play of a king 14D. Kings 14D and 15D may move in any direction, but may only pocket (i.e. sink) opponent's balls that are no further than one row away either up or down the table or to the sides. Rows are denoted by the diamonds 16 on the rails 12 (See FIG. 1). No combination or bank shots are permitted.

Additional rules may include: when a player strikes his object ball with the cue stick for a position play, it must move at least one row (i.e. the length between diamonds 16 on the rails 12); when a player strikes his object ball to pocket an opponent's ball, one of the balls must move at least the distance of a row, if the opponent's ball is not successfully pocketed; all shots must be called in advance (i.e. no pocketing by slop shots); and, player striking more than one ball on the table in addition to the balls he intended to legitimately strike during a shot is a foul. For example, a player intending to combinate a series of three balls with his knight is permitted the use of all four "object" balls to execute his move. If one of these balls veers off course and strikes two or more other balls, the player has fouled. Note that one collateral ball strike may be permitted per each move.

Another way a player may commit a foul is if the player fails to strike his intended object ball and unintentionally strikes another ball. There is no penalty for either failing to pocket a ball or for simply advancing a ball without striking another ball. However, a foul does occur when a ball other than the object ball is first struck with primary ball acting as a cue ball.

Since the balls may have a very specific manner in which each ball may be played, there exist several fouls related to errors in playing a ball correctly. For example, any ball that a player chooses to simply move for position during his turn (either to advance up or down the table or to block an opponent's ball) must travel at least into an adjacent zone as marked by the diamonds 16 on rails 12. If the ball does not travel the required distance, then it is a foul. Pawns 14C and 15C may never move backward whether they are advancing for position or pocketing another ball. Kings 14D and 15D may only pocket an opponent's ball when it is within an area no further than one space as indicated by diamonds 16 on rails 12. Finally, any piece that violates its own inherent mode of play is guilty of fouling. For example, a rook may not perform combination or bank shots. If a rook performs a combination or bank shot it is a foul.

The penalty for fouling is as follows. Since all of a player's balls are, in effect, cue balls, the opponent is permitted to choose any one of his balls remaining on the table to place at any desired location on the table and resume playing.

The rules for scratching may be as follows. During the course of the game, if a player should scratch (i.e. the ball he first contacts with his cue stick drops into a pocket) there is no penalty. An exception is if he is attempting to pocket an opponent's king 14D or 15D. A scratch technically qualifies as a foul, but since the player obviously loses one of his own balls in the process, no further action is warranted. Game play continues with the opponent taking his turn as usual.

When a ball is knocked off of the table, the following rules apply. If the ball on the floor is the player's ball it is considered pocketed and is removed from the game. Game play continues with the opponent taking his turn. If the ball on the floor is the opponents ball, a foul is called against the player and the opponent may place his ball at any desired location on the table. The opponent is not limited to using this ball on his next turn. The opponent may use any ball on his next turn as would normally be the case.

Figure 8:
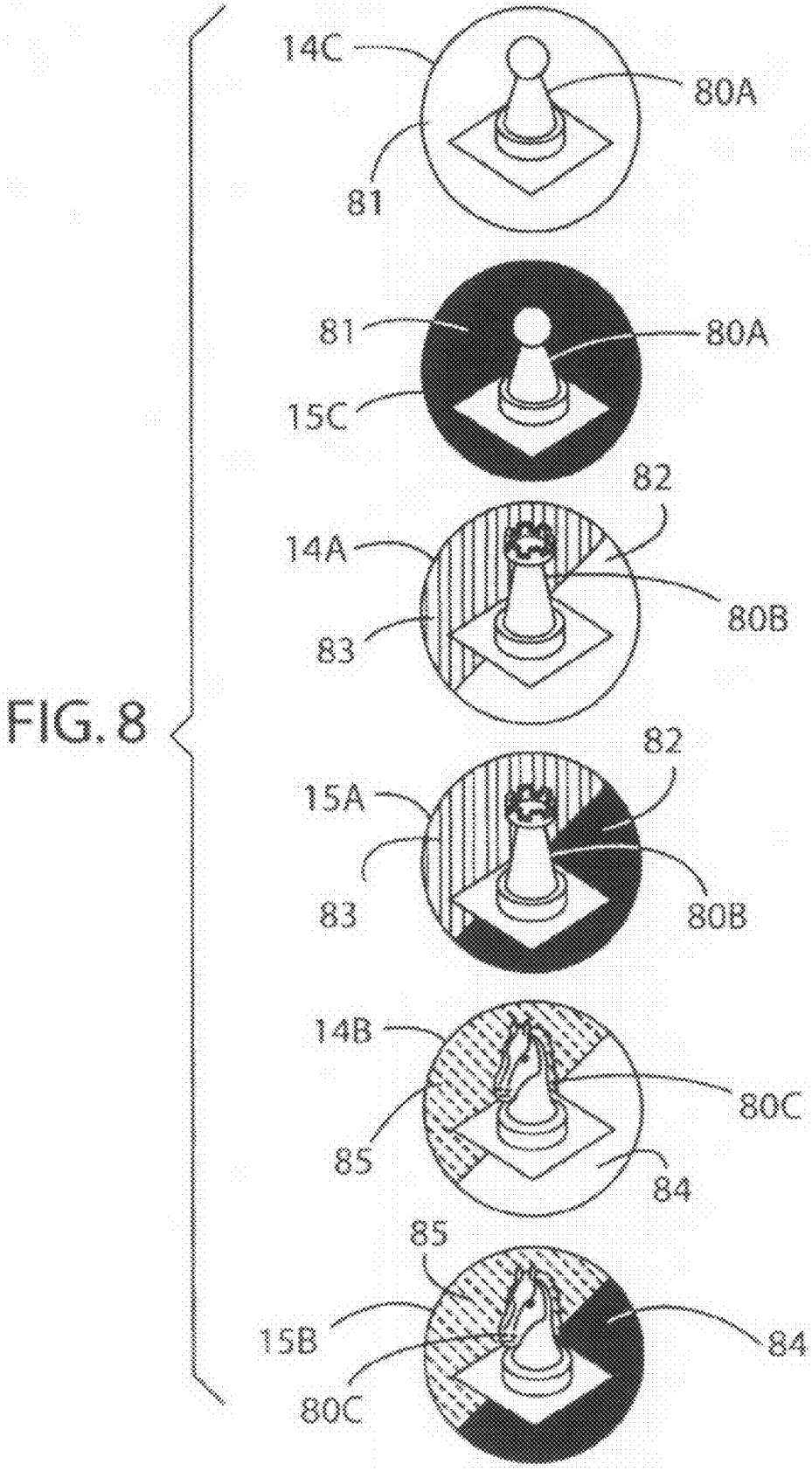
FIGS. 8 and 9 illustrate indicia used on the billiard balls in one embodiment of the present invention.

FIG. 8 illustrates one preferred indicia and coloring on pawns 14C and 15C, on rooks 14A and 15A, and on knights 14B and 15B. White pawn 14C is essentially a white ball with a pawn indicia 80A. The background 81 (i.e. the remaining portion of the ball) is white. Dark pawn 15C is essentially a dark colored ball with a pawn indicia 80A. The background 81 is dark. Many of the balls have two colors, one color indicative of team and one color indicative of the chess piece it represents. For example, rooks 14A and 15A have two tone colors. White rook 14A includes a rook indicia 80B, a team color half 82, and a rook color half 83. The team color 82 is white and the rook color 83 is red. Since the drawings are black and white, the red color is obviously represented as dark shading. Because half the ball is white in color and half the ball is red in color, players know the identity of the ball even if the rook indicia 80B is not visible. Similarly, dark rook 15A includes a rook indicia 80B, a team color half 82, and a rook color half 83. The team color 82 is black and the rook color 83 is red. Knights 14B and 15B have a similar two tone color scheme. White knight 14B includes a knight indicia 80C, a team color half 84, and a knight color half 85. The team color 84 is white and the knight color half 85 is light purple. Again, since half the ball is white and half the ball is light purple, players can identify the balls even if the knight indicia 80C is not visible. Similarly, dark knight 15B includes a knight indicia 80C, a team color half 84, and a knight color half 85. The team color 84 is black while the knight color 85 is light purple.

Figure 9:
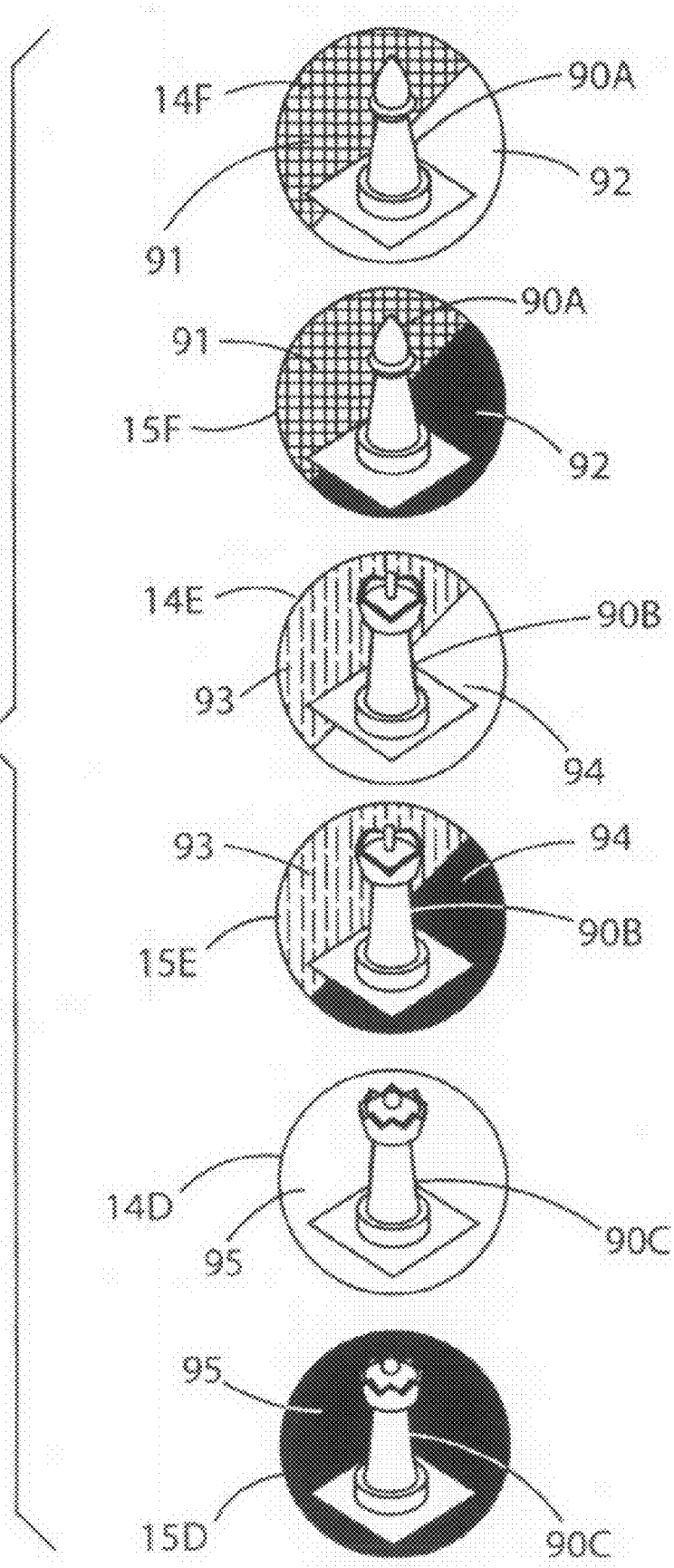

Referring now to FIG. 9, there is illustrated the preferred indicia and coloring for bishops 14F and 15F, queens 14E and 15E, and kings 14D and 15D. Bishops 14F and 15F have two tone colors. White bishop 14F includes a bishop indicia 90A, a team color half 92, and a bishop color half 91. The team color 92 is white and the bishop color 91 is yellow. Since half the ball is white in color and half the ball is yellow in color, the players can identify the ball even if the bishop indicia 90A is not visible. Similarly, dark bishop 15F includes a bishop indicia 90A, a team color half 92, and a bishop color half 91. The team color 92 is black while the bishop color 91 is yellow. Queens 14E and 15E have a similar two tone color scheme. White queen 14E includes a queen indicia 90B, a team color half 94, and a queen color half 93. The team color 94 is white and the queen color half 93 is dark purple. Finally, kings 14D and 15D have a color scheme similar to pawns 14C and 15C. White king 14D is essentially a white ball with a king indicia 90C. The background 95 (i.e. the remaining portion of the ball) is white. Dark king 15D is essentially a dark colored ball with a king indicia 90C. The background 95 is dark.

Figure 10:
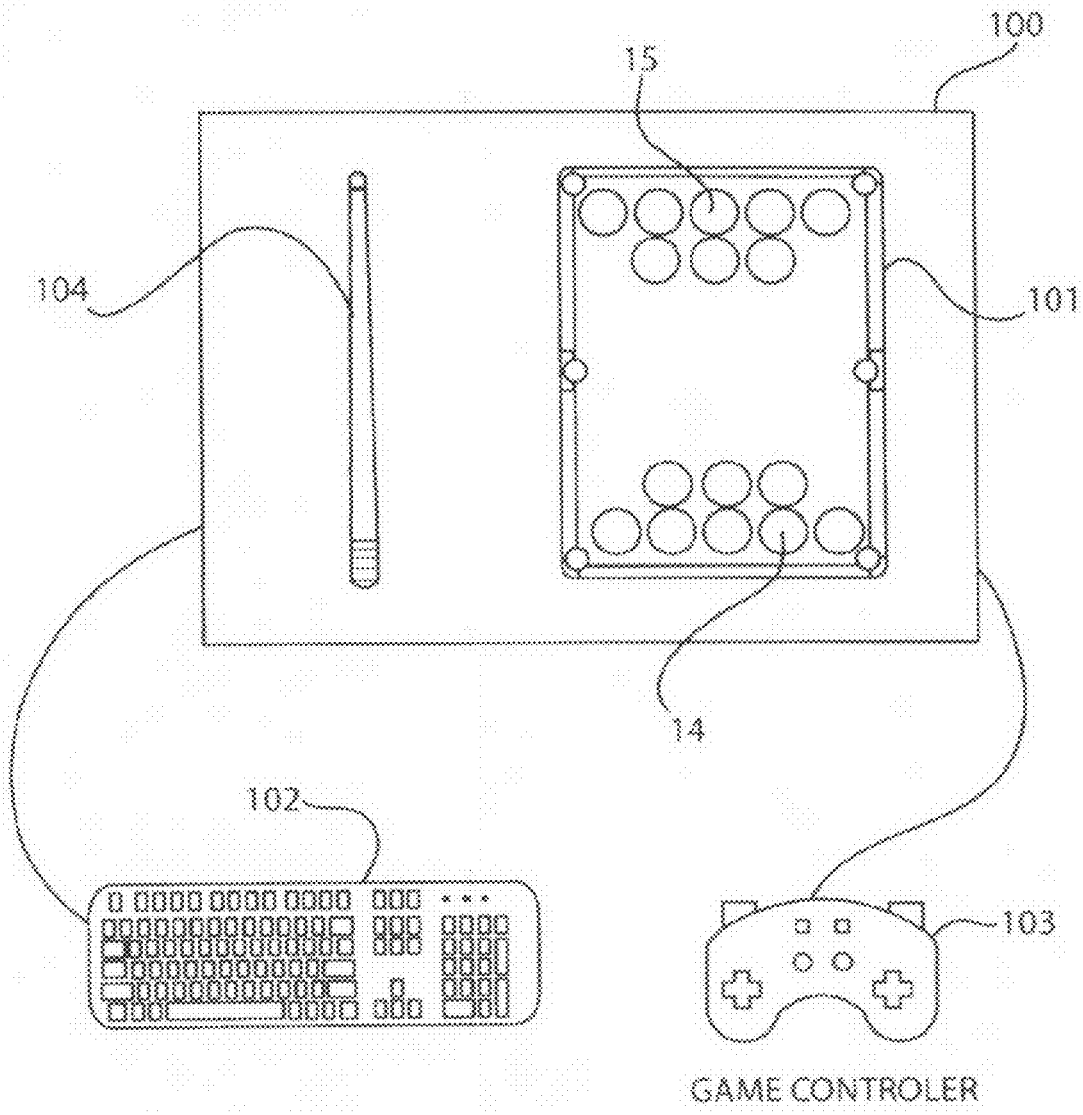
FIG. 10 illustrates the invention implemented on an electronic gaming system in one embodiment of the present invention; and, FIG. 11 shows a cue stick used to practice the invention in one embodiment of the present invention.

Turning now to FIG. 10 there is illustrated the invention implemented on an electronic display screen 100. Billiard table representation 101 is shown displayed on electronic display 100 along with white balls 14 and dark balls 15. Cue stick representation 104 is also shown represented on display screen 100. Those skilled in the art understand that representations of cue sticks in electronic games vary widely. Frequently the cue stick is merely represented with various arrows or target symbols to aid a player in striking a ball as desired.

Keyboard 102 and game controller 103 are shown in communication with display screen 100. Various user interfaces are envisioned that will permit a player to play the inventive game. Virtually any game controller device can be adapted and used to play the inventive game, including, but not limited to, voice commands, wireless controllers, and the like.

Figure 11:
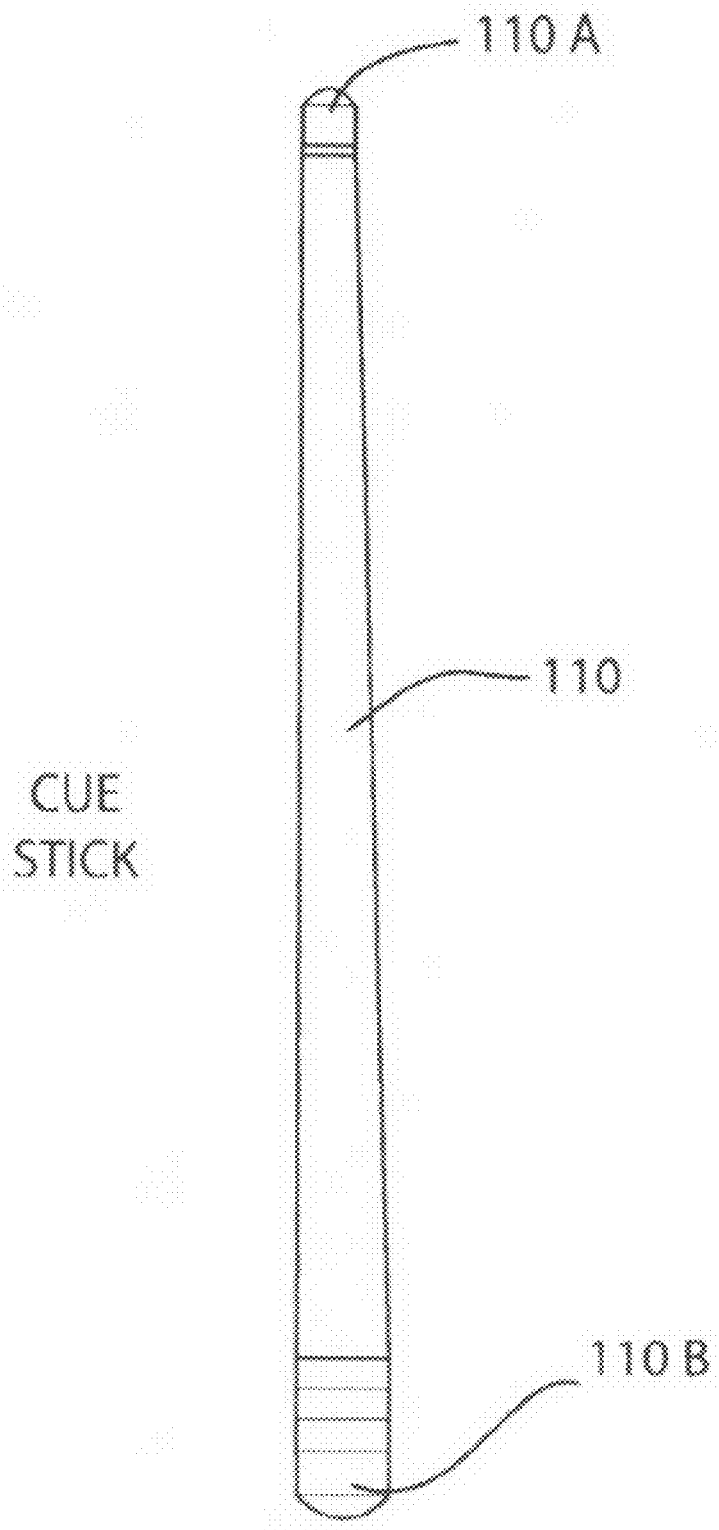

FIG. 11 shows a conventional cue stick 110 used to play the inventive game. Cue stick 110 includes a tip end 110A and a butt end 110B. While this is a conventional cue stick, it is understood that virtually any cue stick may be used to practice the invention.

Figure 12:
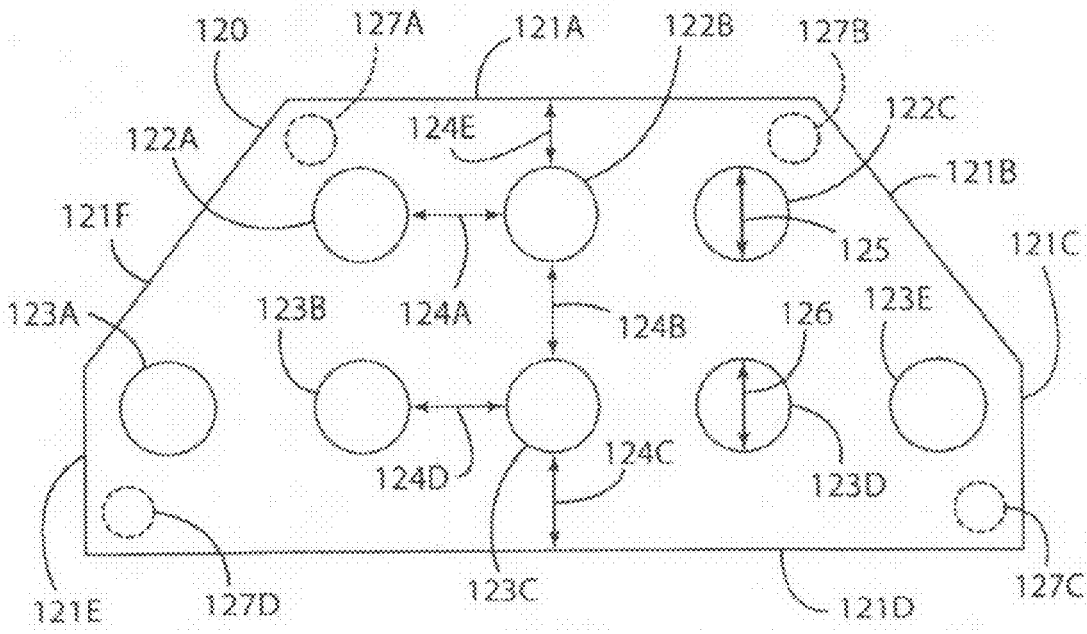
FIG. 12 illustrates one embodiment of a rack used to practice one aspect of the invention.

FIG. 12 illustrates one embodiment of a rack for use in the invention. Rack 120 is designed and intended to properly position balls during game set-up. An aspect of rack 120 is the separation distance that rack 120 provides between adjacent balls and between balls and the end rails 12C and 12D. Rack 120 is preferably cut from a sheet of material such as wood or plastic that is preferably from ¼ inch to 1 inch thick. However, those skilled in the art understand that various thicknesses may be used and various materials may be used as long as the resulting rack is suitable for holding the balls in place. Rack 120 may also be assembled from multiple pieces of material to create the desired design.

The elements shown in FIG. 12 will be briefly listed, then discussed in more detail. Shown in FIG. 12 are sides 121, pawn apertures 122, rook aperture 123A, knight aperture 123B, king aperture 123C, queen aperture 123D, and bishop aperture 123E.

Sides 121 include front side 121A, right diagonal side 121B, right vertical side 121C, rear side 121D, left vertical side 121E, and left diagonal side 121F. Rack 120 is placed snugly adjacent to a player's end rail 12C or 12D so that rear side 121D is in contact with an end rail 12C or 12D along it's length. Rack 120 is aligned with the center of the end rail 12C or 12D. For a conventional size billiard table the following dimensions are preferred, but those skilled in the art understand that other dimensions may be used to practice the invention. Front side 121A is 13½ inches, right diagonal side 121B and left diagonal side 121F are 8½ inches, right vertical side 121C and left vertical side 121E are 4¾ inches, and rear side 121D is 23¾ inches.

A significant aspect of rack 120 are the distances between apertures 122 and 123, and the distances between apertures 123 and rear side 121D. The distance between apertures is preferably 2½ inches. This distance provides adequate separation between the balls 14 and 15 so that a player may strike a ball without disrupting the other balls 14 and 15. It is understood that these dimension are merely the preferred dimensions for a conventional size billiard table and that reduced sizes would be preferred for smaller billiard tables or smaller balls. Separation distances 124 are illustrated in FIG. 12. Separation distances 124 are all preferably 2½ inches. Separation distance 124A shows the 2½ inch separation between pawn apertures 122A and 122B. Separation distances 124B shows the 2½ inch separation between the first and second row apertures 122 and 123. Separation distance 124C shows the 2½ inch separation between the king aperture 123C and rear side 121D. Separation distance 124D shows the 2½ inch separation between knight aperture 123B and king aperture 123C. Finally, separation distance 124E shows the preferred 2½ inch distance between pawn aperture 122B and front side 121A.

Apertures 122 and 123 are for retaining pieces 14 and 15 so that they are positioned precisely the same every time. Apertures 122 and 123 are slightly larger than the diameter of the pieces 14 and 15 and are preferably lined with felt to aide in the precise positioning of the pieces 14 and 15. In some preferred embodiments, queen aperture 123D is slightly larger than the other apertures 122 and 123 because some embodiments of the invention require the queen pieces 14E and 15E to be slightly larger than the other pieces 14 and 15. Aperture diameter 125 is slightly larger than the diameter of the pieces 14 and 15. The diameter 126 of queen aperture 123D is slightly larger than the diameter of the queen pieces 14E and 15E.

Legs 127 are for supporting rack 120. Legs 127 are preferably only ¼ to ½ inches high for supporting rack 120 an appropriate height above the playing surface 11.

Those skilled in the art understand that these examples are illustrative of the invention and that many other configurations of playing surfaces, ball designs, numbers of balls used, and modifications of the rules of play can be extrapolated from these descriptions.

These descriptions illustrate the advantage of the invention. For example, players must think about their shots. In a conventional billiard game, players merely choose the most advantageous or easy shot. However, in the invention, players must consider what types of shots are available to them. Some balls can only be used to make straight-in shots. Other balls can only make bank shots. Still other balls can only make combination shots. Players must also consider that some balls can only move in one direction and some balls can only strike balls that are within a limited distance. In addition, a player must consider what balls can be legally sunk (e.g. the opponent's king must be sunk last). Finally, a player must consider many tactical and strategic factors such as the value or power of a piece. For example, a queen may be a much more valuable ball than a mere pawn.

An advantage is that the invention is easily adapted to billiard tables worldwide. Another advantage is that it may be adapted to various playing surfaces or display screens. Yet another advantage is that it eliminates that possibility of one player "running the table" and sinking all balls in one turn. Still another advantage is the appeal to all ages and skill levels. Yet still another advantage is an improved intellectual challenge in playing the game.

The method of the invention follows from the description of the apparatus above. The method steps comprise:

Providing a playing surface;

Providing a plurality of balls having indicia of chess pieces;

Providing a rack for enabling proper positioning of balls during set-up;

Placing said balls on said playing surface in predetermined initial positions;

Striking said balls according to rules of play adapted from the game of chess;

Wherein said rules of play include at least one ball that can only sink an opponent's ball with a straight-in shot;

Wherein said rules of play include at least one ball that can only sink an opponent's ball with a bank shot;

Wherein said rules of play include at least one ball that can only sink an opponent's ball with a combination shot;

Wherein at least one of said balls has indicia indicative of a king;

Wherein at least one of said balls has indicia indicative of a queen;

Wherein at least one of said balls has indicia indicative of a rook;

Wherein at least one of said balls has indicia indicative of a knight;

Wherein at least one of said balls has indicia indicative of a bishop;

Wherein at least one of said balls has indicia indicative of a pawn;

Wherein at least one of said balls with indicia of a pawn is permitted to only move forward toward the opposing player's side; and, Wherein at least one of said balls comprises two colors, one color indicative of the team and one color indicative of the type of chess piece the ball represents.

The specific configurations and features of the invention may vary according to specific requirements. In the preferred embodiment, the invention is generally used on a conventional billiard table. However, the invention may be adapted to various billiard tables and playing surfaces. Further, although only a few embodiments of the invention have been illustrated, it is understood that many adaptations of the invention may be implemented without departing from the spirit of the invention.

The solutions offered by the invention disclosed herein have thus been attained in an economical, practical, and facile manner. To whit, a novel game and method of play which is cost effective, easily adapted to most types of billiard tables, and quickly learned to play has been invented. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to be appreciated that various changes, rearrangements, and modifications may be made therein, without departing from the scope of the invention as defined by the claims.

The invention claimed is:

1. Game equipment for use with a billiard table comprising a plurality of billiard balls, each of said billiard balls having an indicia representative of a chess piece of which each indicium dictates a specific allowable mode of play for said balls and a rack of irregular hexagonal configuration for positioning a portion of said billiard balls into two rows, whereby each ball is equidistantly separated from adjacent balls;

wherein said plurality of billiard balls comprise sixteen balls of two differently colored sets of eight balls, each set racked at opposite ends of said billiard table, wherein each of said billiard balls functioning as a cue ball;

wherein the two differently colored sets of eight balls in each said set respectively bear representations of chess pieces indicative of a king, queen, bishop, knight, rook and pawn;

wherein said billiard balls of said different colored set are racked at opposite ends of a billiard table forming first and second rows, said first row comprising three pawns; said second row comprising a rook, a knight, a king, a queen, and a bishop and wherein said indicia are pictorial symbols which dictate a proper usage or limitation thereof in play of said billiard balls.

2. The game equipment of claim 1 wherein said rack is generally of rigid construction and of irregular hexagonal configuration for positioning a portion of said billiard balls into said first and second rows, wherein all of said billiard balls are equidistantly separated from adjacent balls within a particular row and wherein six of said balls are equidistantly separated from adjacent billiard balls of a juxtaposed row.

3. The game equipment of claim 1 wherein said playing surface, said plurality of balls, and said at least one pocket are virtual and are represented on an electronic display screen.

* * * * *